US006230723B1

(12) United States Patent
Hixson

(10) Patent No.: US 6,230,723 B1
(45) Date of Patent: May 15, 2001

(54) UMBRELLA WITH FAN ASSEMBLY

(76) Inventor: Sondra D. Hixson, 1223 Walker Ave., St. Louis, MO (US) 63138

( * ) Notice: Subject to any disclaimer, the term of this patent is extended or adjusted under 35 U.S.C. 154(b) by 0 days.

(21) Appl. No.: 09/328,181

(22) Filed: Jun. 8, 1999

(51) Int. Cl.[7] ..... A45B 3/00
(52) U.S. Cl. ..... 135/16
(58) Field of Search ..... 135/16; 416/142; 417/313, 234

(56) References Cited

U.S. PATENT DOCUMENTS

| | | | | |
|---|---|---|---|---|
| 1,148,332 | * | 7/1915 | Onyskow | 135/16 |
| 3,177,881 | | 4/1965 | Covington | 135/16 |
| 3,444,799 | | 5/1969 | Covington | 98/1 |
| 5,007,811 | | 4/1991 | Hopkins | 135/16 |
| 5,172,711 | | 12/1992 | Mueller et al. | 135/16 |
| 5,207,238 | | 5/1993 | Rivera et al. | 135/16 |
| 5,273,062 | * | 12/1993 | Mozdzanowski | 135/16 |
| 5,349,975 | | 9/1994 | Valdner | 135/16 |
| 6,027,309 | * | 2/2000 | Rawls et al. | 416/5 |

* cited by examiner

*Primary Examiner*—Robert Canfield
(74) *Attorney, Agent, or Firm*—Joseph N. Breaux

(57) ABSTRACT

An umbrella having a cover within which a fan is mounted. The fan includes a ring shaped fan gear that is rotatably mounted on a section of a tubular vertical support tube and includes a number of pivoting fan blades that collapse when the cover is collapsed.

1 Claim, 3 Drawing Sheets

UMBRELLA WITH FAN ASSEMBLY

TECHNICAL FIELD

The present invention relates to sun protection devices and more particularly to an umbrella with a fan assembly that includes an umbrella assembly having a fan assembly located beneath a fabric canopy of the umbrella assembly; the umbrella assembly including a tubular vertical support tube having a handle at one end provided with a battery compartment and a fan motor activation switch, connecting wires running along the length thereof into connection with a fan motor of the fan assembly, and a collapsible rain canopy assembly including the fabric canopy attached to a collapsible canopy support frame in connection with the other end of the tubular vertical support tube; the fan assembly including a fan motor in controlled electrical connection with the motor activation switch through the connecting wires, a drive gear attached to an end of a motor shaft of the fan motor, a ring shaped fan blade assembly including a ring shaped fan gear rotatably mounted on a section of the tubular vertical support tube that is integrally formed with a fan blade attachment section having a number of pivot mounts each having a pivoting fan blade attached thereto such that rotation of the ring shaped fan gear about the tubular vertical support tube causes the pivoting fan blades to extend out radially from the fan blade attachment section, and a fan gear thrust bearing rigidly mounted to the tubular vertical support tube and limiting movement of the ring shaped fan gear along the tubular vertical support tube in a direction toward the handle; the fan motor being rigidly attached to the tubular vertical support tube such that the drive gear attached to the motor shaft engages the ring shaped fan gear in a manner to cause rotation of the ring shaped fan gear about the section of the tubular vertical support tube by rotation of the drive gear.

BACKGROUND ART

Although umbrellas are typically used as a shield against rain and the like, they are often used to shield a user from the sun during hot weather. Although the cover of the umbrella provides a sun shield to shade to a user, shade alone is often not sufficient to keep the user cool in hot weather. It would be a benefit, therefore, to have an umbrella that included an air moving device, such as a fan, to generate a cooling breeze directed at the user to provide cooling in addition to providing relief from sun rays.

GENERAL SUMMARY DISCUSSION OF INVENTION

It is thus an object of the invention to provide an umbrella with fan assembly that includes an umbrella assembly having a fan assembly located beneath a fabric canopy of the umbrella assembly; the umbrella assembly including a tubular vertical support tube having a handle at one end provided with a battery compartment and a fan motor activation switch, connecting wires running along the length thereof into connection with a fan motor of the fan assembly, and a collapsible rain canopy assembly including the fabric canopy attached to a collapsible canopy support frame in connection with the other end of the tubular vertical support tube; the fan assembly including a fan motor in controlled electrical connection with the motor activation switch through the connecting wires, a drive gear attached to an end of a motor shaft of the fan motor, a ring shaped fan blade assembly including a ring shaped fan gear rotatably mounted on a section of the tubular vertical support tube that is integrally formed with a fan blade attachment section having a number of pivot mounts each having a pivoting fan blade attached thereto such that rotation of the ring shaped fan gear about the tubular vertical support tube causes the pivoting fan blades to extend out radially from the fan blade attachment section, and a fan gear thrust bearing rigidly mounted to the tubular vertical support tube and limiting movement of the ring shaped fan gear along the tubular vertical support tube in a direction toward the handle; the fan motor being rigidly attached to the tubular vertical support tube such that the drive gear attached to the motor shaft engages the ring shaped fan gear in a manner to cause rotation of the ring shaped fan gear about the section of the tubular vertical support tube by rotation of the drive gear.

Accordingly, an umbrella with fan assembly is provided. The umbrella with fan assembly includes an umbrella assembly having a fan assembly located beneath a fabric canopy of the umbrella assembly; the umbrella assembly including a tubular vertical support tube having a handle at one end provided with a battery compartment and a fan motor activation switch, connecting wires running along the length thereof into connection with a fan motor of the fan assembly, and a collapsible rain canopy assembly including the fabric canopy attached to a collapsible canopy support frame in connection with the other end of the tubular vertical support tube; the fan assembly including a fan motor in controlled electrical connection with the motor activation switch through the connecting wires, a drive gear attached to an end of a motor shaft of the fan motor, a ring shaped fan blade assembly including a ring shaped fan gear rotatably mounted on a section of the tubular vertical support tube that is integrally formed with a fan blade attachment section having a number of pivot mounts each having a pivoting fan blade attached thereto such that rotation of the ring shaped fan gear about the tubular vertical support tube causes the pivoting fan blades to extend out radially from the fan blade attachment section, and a fan gear thrust bearing rigidly mounted to the tubular vertical support tube and limiting movement of the ring shaped fan gear along the tubular vertical support tube in a direction toward the handle; the fan motor being rigidly attached to the tubular vertical support tube such that the drive gear attached to the motor shaft engages the ring shaped fan gear in a manner to cause rotation of the ring shaped fan gear about the section of the tubular vertical support tube by rotation of the drive gear.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
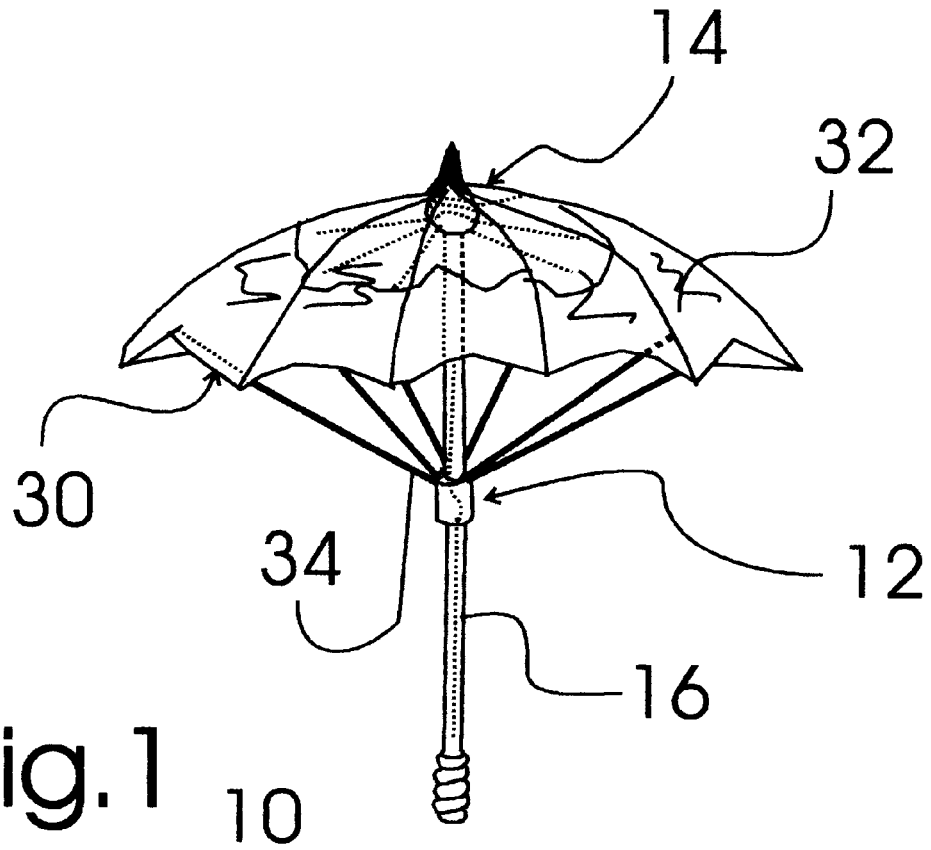
FIG. 1 is a side view of an exemplary embodiment of the umbrella with fan assembly of the present invention showing the umbrella assembly with a portion of the fabric canopy of the umbrella assembly cut away to show the fan assembly; the umbrella assembly including a tubular vertical support tube having a handle at one end provided with a battery compartment and a fan motor activation switch, connecting wires running along the length thereof into connection with a fan motor of the fan assembly, and a collapsible rain canopy assembly including a fabric canopy attached to a collapsible canopy support frame in connection with the other end of the tubular vertical support tube; the fan assembly including a fan motor in controlled electrical connection with the motor activation switch through the connecting wires, a drive gear attached to an end of a motor shaft of the fan motor, a ring shaped fan blade assembly including a ring shaped fan gear rotatably mounted on a section of the tubular vertical support tube that is integrally formed with a fan blade attachment section having a number of pivot mounts each having a pivoting fan blade attached thereto such that rotation of the ring shaped fan gear about the tubular vertical support tube causes the pivoting fan blades to extend out radially from the fan blade attachment section, and a fan gear thrust bearing rigidly mounted to the tubular vertical support tube and limiting movement of the ring shaped fan gear along the tubular vertical support tube in a direction toward the handle; the fan motor being rigidly attached to the tubular vertical support tube such that the drive gear attached to the motor shaft engages the ring shaped fan gear in a manner to cause rotation of the ring shaped fan gear about the section of the tubular vertical support tube by rotation of the drive gear.

FIG. 1 shows an exemplary embodiment of the umbrella with fan assembly of the present invention, generally designated 10. Umbrella with fan assembly 10 includes an umbrella assembly, generally designated 12, and a fan assembly, generally designated 14.

Figure 2:
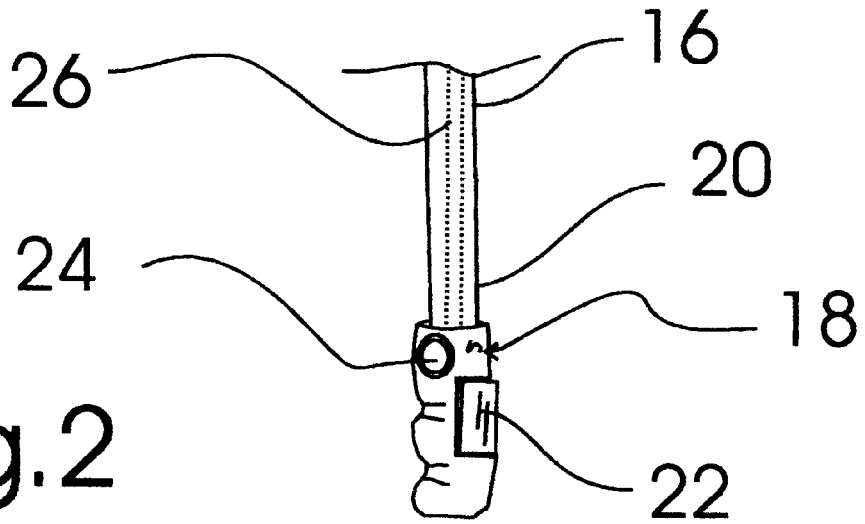
FIG. 2 is a partial plan view of the handle at one end of the tubular vertical support tube showing the battery compartment, the fan motor activation switch and a portion of the connecting wires running through the tubular vertical support tube.

Umbrella assembly 12 includes a tubular vertical support tube 16 having, with reference to FIG. 2, a handle, generally designated 18, at one end 20 that is provided with a battery compartment 22 and a fan motor activation switch 24. Connecting wires 26, referring back to FIG. 1, run through tubular vertical support tube 16 along the length connecting fan motor activation switch 24 (FIG. 2) with a fan motor 28 (FIGS. 4 and 5) of fan assembly 14. Umbrella assembly 12 also includes a collapsible rain canopy assembly, generally designated 30 including a fabric canopy 32 attached to a collapsible canopy support frame 34 in connection with the other end of tubular vertical support tube 16.

Figure 3:
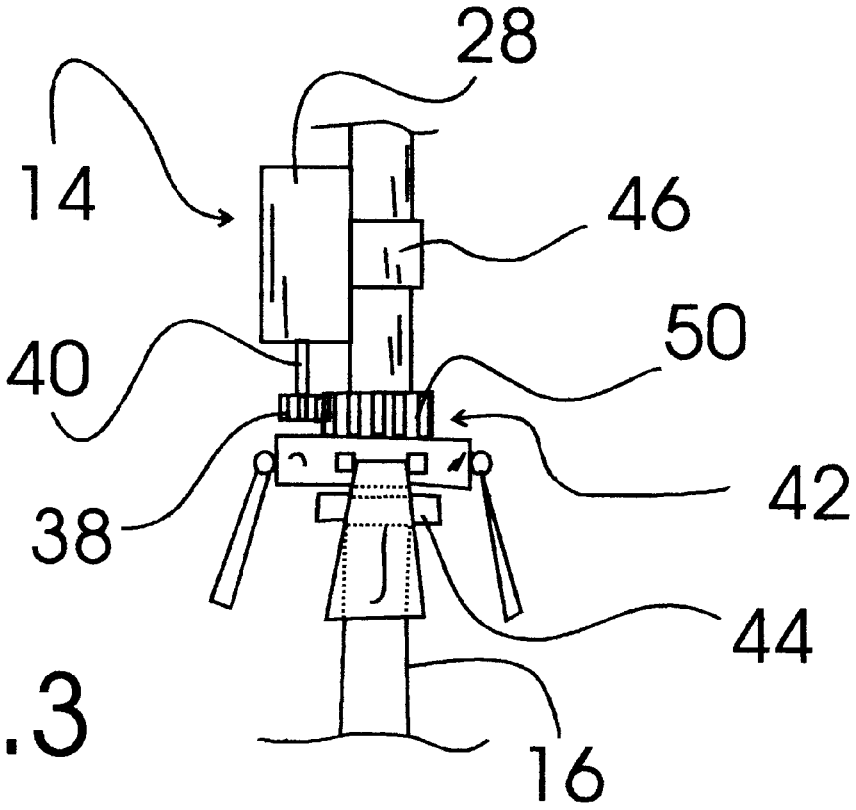
FIG. 3 is a side plan view of the fan assembly showing the fan motor rigidly attached to the tubular vertical support tube with a motor attachment bracket, the drive gear attached to the motor shaft, the ring shaped fan blade assembly rotatably mounted on a section of the tubular vertical support tube, and the fan gear thrust bearing rigidly mounted to the tubular vertical support tube below the ring shaped fan blade assembly.

With reference to FIG. 3, fan assembly 14 includes fan motor 28; a drive gear 38 attached to an end of a motor shaft 40 of fan motor 28; a ring shaped fan blade assembly, generally designated 42; and a fan gear thrust bearing 44 rigidly mounted to tubular vertical support tube 16 below ring shaped fan blade assembly 42. Fan motor 28 is rigidly secured to tubular vertical support tube 16 with a motor mount bracket 46 such that drive gear 38 is positioned into meshed engagement with a ring shaped fan gear 50 of ring shaped fan blade assembly 42 and in a manner to prevent ring shaped fan gear 50 from sliding upward along tubular vertical support tube 16 toward fan motor 28 an amount sufficient to remove ring shaped fan gear 50 from meshed engagement with drive gear 38.

Figure 4:
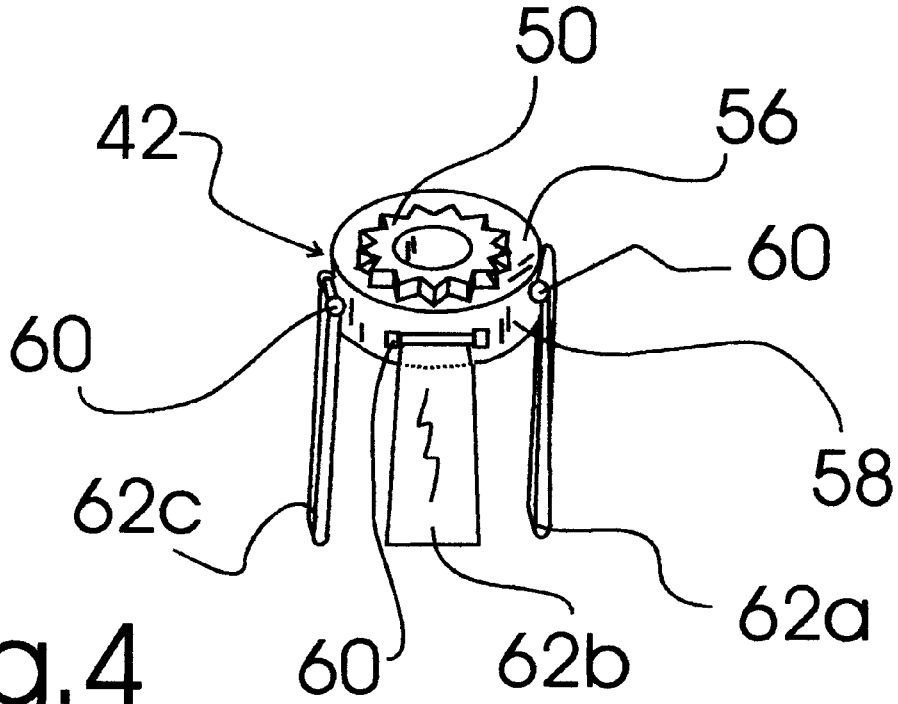
FIG. 4 is a perspective view of the ring shaped fan blade assembly of the fan assembly in isolation including a ring shaped fan gear having a vertical support tube passageway formed through the center thereof, integrally formed with a fan blade attachment section having four pivot mounts (only three shown) each having a pivoting fan blade attached thereto.
Figure 5:
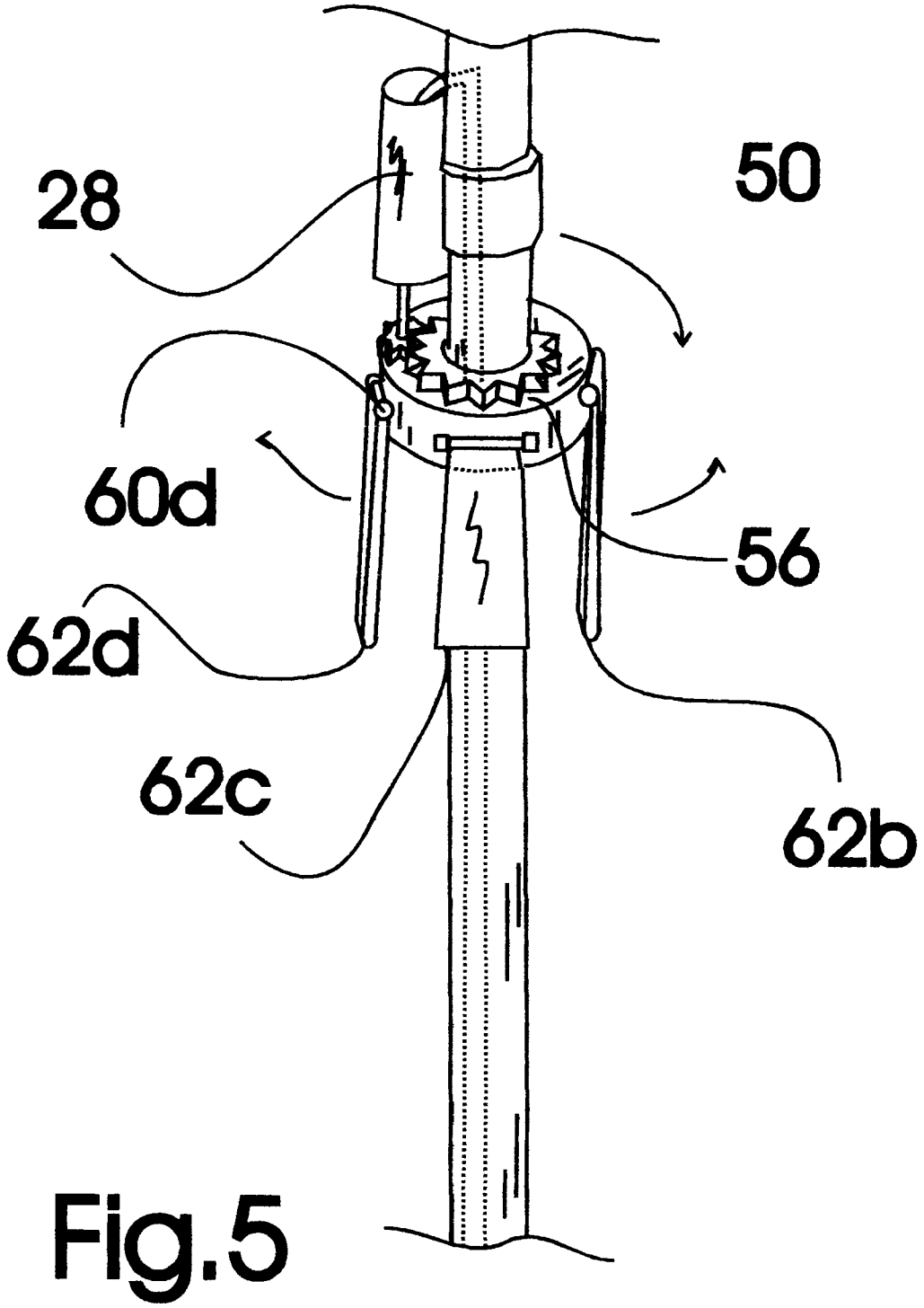
FIG. 5 is a perspective view of the fan assembly showing the fan motor rigidly attached to the tubular vertical support tube with the motor attachment bracket, the drive gear attached to the motor shaft, and the ring shaped fan blade assembly rotatably mounted on a section of the tubular vertical support tube.

With reference to FIG. 4, ring shaped fan blade assembly also includes a fan blade attachment section 56 that is integrally formed with ring shaped fan gear 50. A side surface 58 of fan blade attachment section 56 is provided with four pivot mounts 60*a–d* (only three shown, see also FIG. 5) spaced at ninety degree intervals around the circumference thereof. A pivoting fan blade 62*a–d* is pivotally attached to each pivot mount such that, referring now to FIG. 5, rotation of the ring shaped fan gear 50 about tubular vertical support tube 16 causes a centrifugal force acting to pivot fan blades 62-*ad* out radially from the fan blade attachment section 56.

With general reference to FIGS. 1–5, in use fan blades 62*a–d* pivot down when collapsible rain canopy assembly 30 is collapsed. When it is desired to have a cooling breeze from fan assembly 14 the user need only depress fan motor activation switch 24.

It can be seen from the preceding description that an umbrella with fan assembly has been provided that includes an umbrella assembly having a fan assembly located beneath a fabric canopy of the umbrella assembly; the umbrella assembly including a tubular vertical support tube having a handle at one end provided with a battery compartment and a fan motor activation switch, connecting wires running along the length thereof into connection with a fan motor of the fan assembly, and a collapsible rain canopy assembly including the fabric canopy attached to a collapsible canopy support frame in connection with the other end of the tubular vertical support tube; the fan assembly including a fan motor in controlled electrical connection with the motor activation switch through the connecting wires, a drive gear attached to an end of a motor shaft of the fan motor, a ring shaped fan blade assembly including a ring shaped fan gear rotatably mounted on a section of the tubular vertical support tube that is integrally formed with a fan blade attachment section having a number of pivot mounts each having a pivoting fan blade attached thereto such that rotation of the ring shaped fan gear about the tubular vertical support tube causes the pivoting fan blades to extend out radially from the fan blade attachment section, and a fan gear thrust bearing rigidly mounted to the tubular vertical support tube and limiting movement of the ring shaped fan gear along the tubular vertical support tube in a direction toward the handle; the fan motor being rigidly attached to the tubular vertical support tube such that the drive gear attached to the motor shaft engages the ring shaped fan gear in a manner to cause rotation of the ring shaped fan gear about the section of the tubular vertical support tube by rotation of the drive gear.

It is noted that the embodiment of the umbrella with fan assembly described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An umbrella with fan assembly comprising:

an umbrella assembly; and a fan assembly located beneath a fabric canopy of said umbrella assembly;

said umbrella assembly including a tubular vertical support tube having battery compartment, a fan motor activation switch, connecting wires running along the length thereof into connection with a fan motor of said fan assembly, and a collapsible rain canopy assembly including said fabric canopy attached to a collapsible canopy support frame in connection with an end of said tubular vertical support tube;

said fan assembly including a fan motor in controlled electrical connection with said motor activation switch through said connecting wires, a drive gear attached to an end of a motor shaft of said fan motor, a ring shaped fan blade assembly including a ring shaped fan gear rotatably mounted on a section of said tubular vertical support tube that is integrally formed with a fan blade attachment section having a number of pivot mounts each having a pivoting fan blade attached thereto such that, when said ring shaped fan gear is not rotating, said pivoting fan blades pivot down, rotation of said ring shaped fan gear about said tubular vertical support tube causing said pivoting fan blades to extend out radially from said fan blade attachment section, and a fan gear thrust bearing rigidly mounted to said tubular vertical support tube beneath said ring shaped fan gear and limiting movement of said ring shaped fan gear along said tubular vertical support tube;

said fan motor being rigidly attached to said tubular vertical support tube such that said drive gear attached to said motor shaft engages said ring shaped fan gear in a manner to cause rotation of said ring shaped fan gear about said section of said tubular vertical support tube by rotation of said drive gear and to prevent said ring shaped fan dear from sliding upward alone said tubular vertical support toward said fan motor an amount sufficient to remove said ring shaped fan gear from meshed engagement with said drive gear.

* * * * *